US011015408B2

(12) United States Patent
Coon et al.

(10) Patent No.: US 11,015,408 B2
(45) Date of Patent: May 25, 2021

(54) FRAC PLUG WITH INTEGRAL SETTING TOOL

(71) Applicant: PetroQuip Energy Services, LLC, Waller, TX (US)

(72) Inventors: Robert Joe Coon, Missouri City, TX (US); Roddie R. Smith, Katy, TX (US); John Lee Emerson, Katy, TX (US)

(73) Assignee: PetroQuip Energy Services, LLC, Waller, TX (US)

( * ) Notice: Subject to any disclaimer, the term of this patent is extended or adjusted under 35 U.S.C. 154(b) by 0 days.

(21) Appl. No.: 17/003,275

(22) Filed: Aug. 26, 2020

(65) Prior Publication Data

US 2021/0062599 A1 Mar. 4, 2021

Related U.S. Application Data

(60) Provisional application No. 62/891,492, filed on Aug. 26, 2019.

(51) Int. Cl.

| | |
|---|---|
| ***E21B 23/06*** | (2006.01) |
| ***E21B 23/04*** | (2006.01) |
| ***E21B 34/14*** | (2006.01) |

(52) U.S. Cl.

CPC ..... *E21B 23/065* (2013.01); *E21B 23/042* (2020.05); *E21B 23/0414* (2020.05); *E21B 23/0415* (2020.05); *E21B 34/142* (2020.05)

(58) Field of Classification Search

CPC ..... E21B 23/04; E21B 23/06; E21B 23/0414; E21B 23/042; E21B 23/0417; E21B 33/128; E21B 33/134; E21B 33/1285; E21B 33/1295; E21B 33/129

See application file for complete search history.

(56) References Cited

U.S. PATENT DOCUMENTS

| | | | | |
|---|---|---|---|---|
| 3,029,872 A * | 4/1962 | Hanes | E21B 23/065 166/63 |
| 3,062,292 A * | 11/1962 | Lowrey | E21B 23/06 166/123 |
| 3,160,209 A * | 12/1964 | Bonner | E21B 23/065 166/63 |
| RE25,846 E * | 8/1965 | Campbell | E21B 33/1295 166/122 |
| 2020/0157913 A1* | 5/2020 | Hern | E21B 33/1285 |

* cited by examiner

*Primary Examiner* — Kipp C Wallace
(74) *Attorney, Agent, or Firm* — Tumey L.L.P.

(57) ABSTRACT

A system combining a setting tool and a frac plug into one assembly thus producing a much shorter and more reliable assembly. More specifically, a downhole assembly comprising a plug section, which itself comprises a top sub, a bottom sub, a slip, and an elastomeric element. The downhole assembly further comprises a power section comprising a body comprising a power charge and one or more ignitors, a firing head, a shearing pin, and a setting tool piston. Additionally, the downhole assembly comprises a check valve, wherein the check valve is positioned downhole from the power charge and inside the setting tool piston; a mandrel comprising a hydraulic chamber and a ball, wherein the mandrel is positioned inside and adjacent to the setting tool piston and the top sub; and a dog.

20 Claims, 5 Drawing Sheets

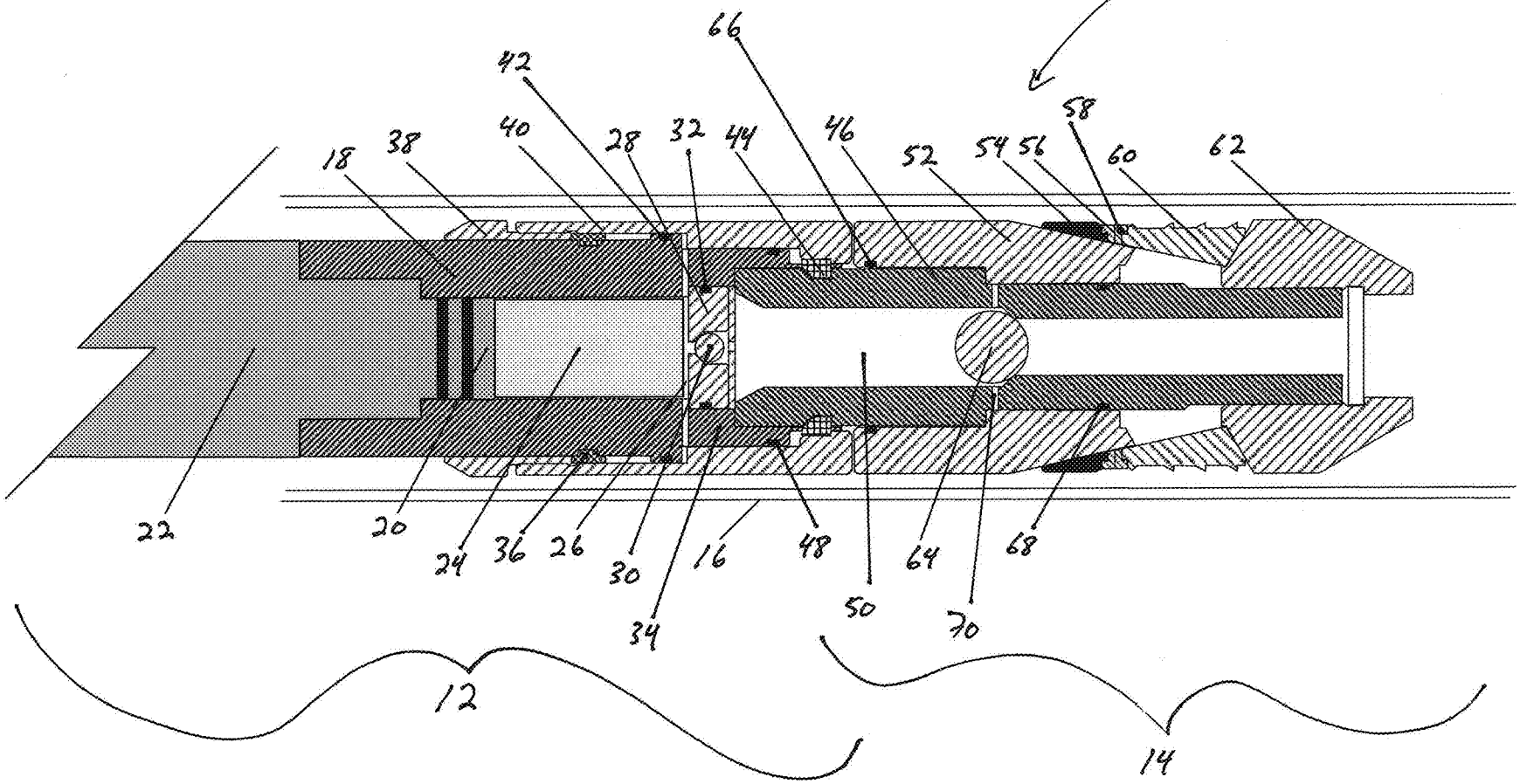
Figure #1 (Run in Position)

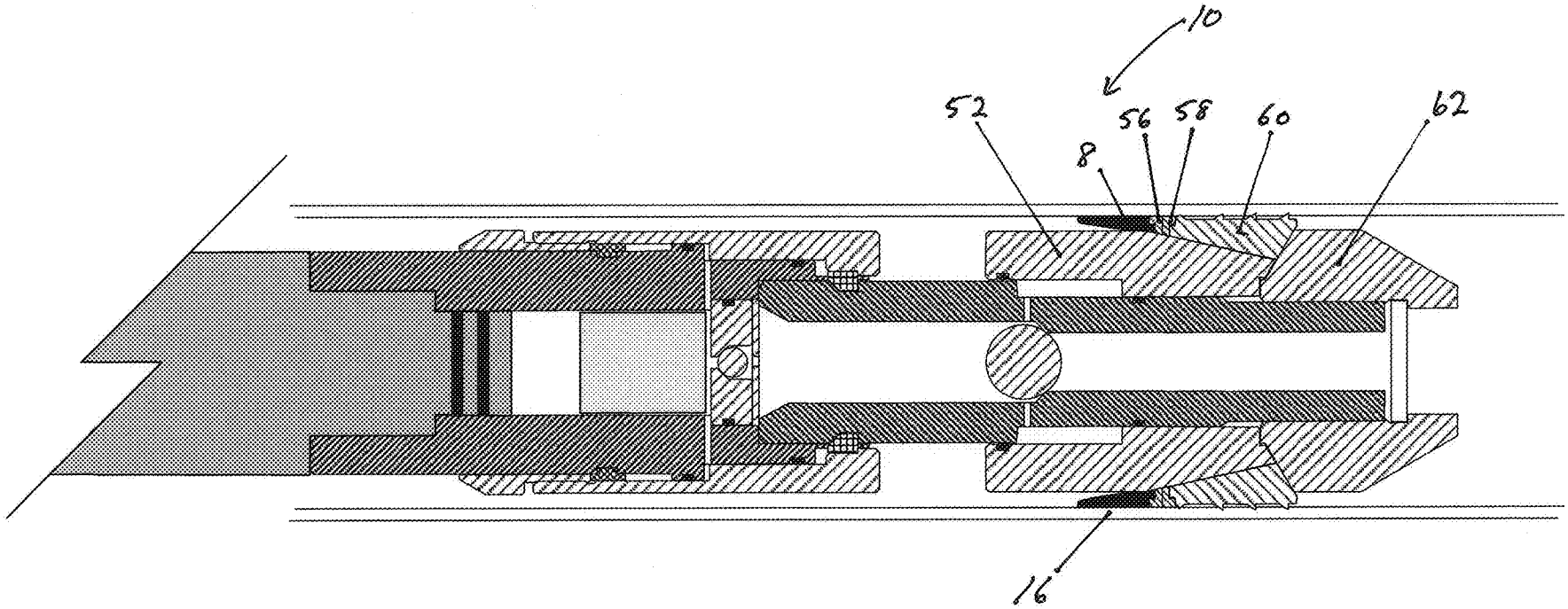
Figure #2 (Plug Set Position)

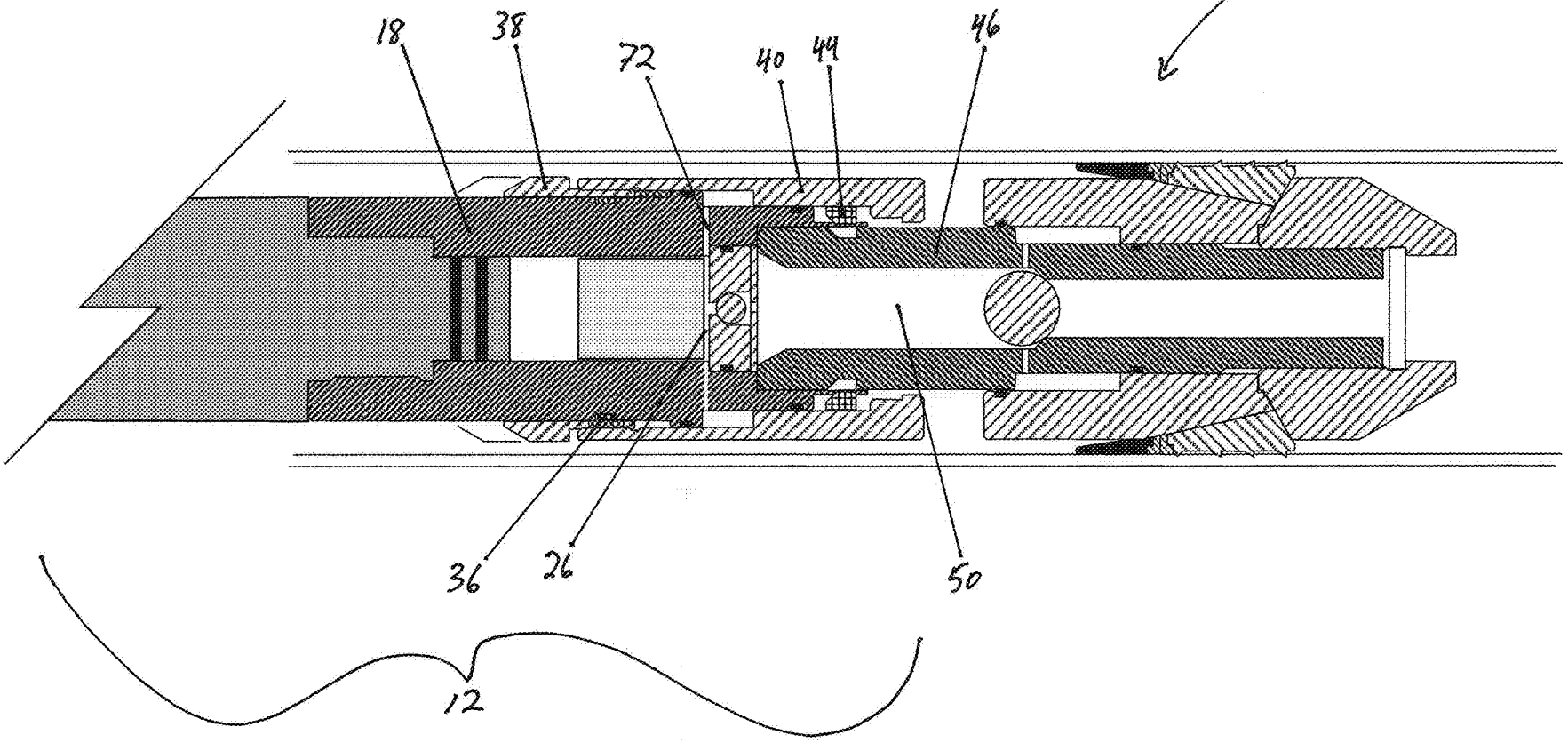
Figure #3 (Power Section Releasing)

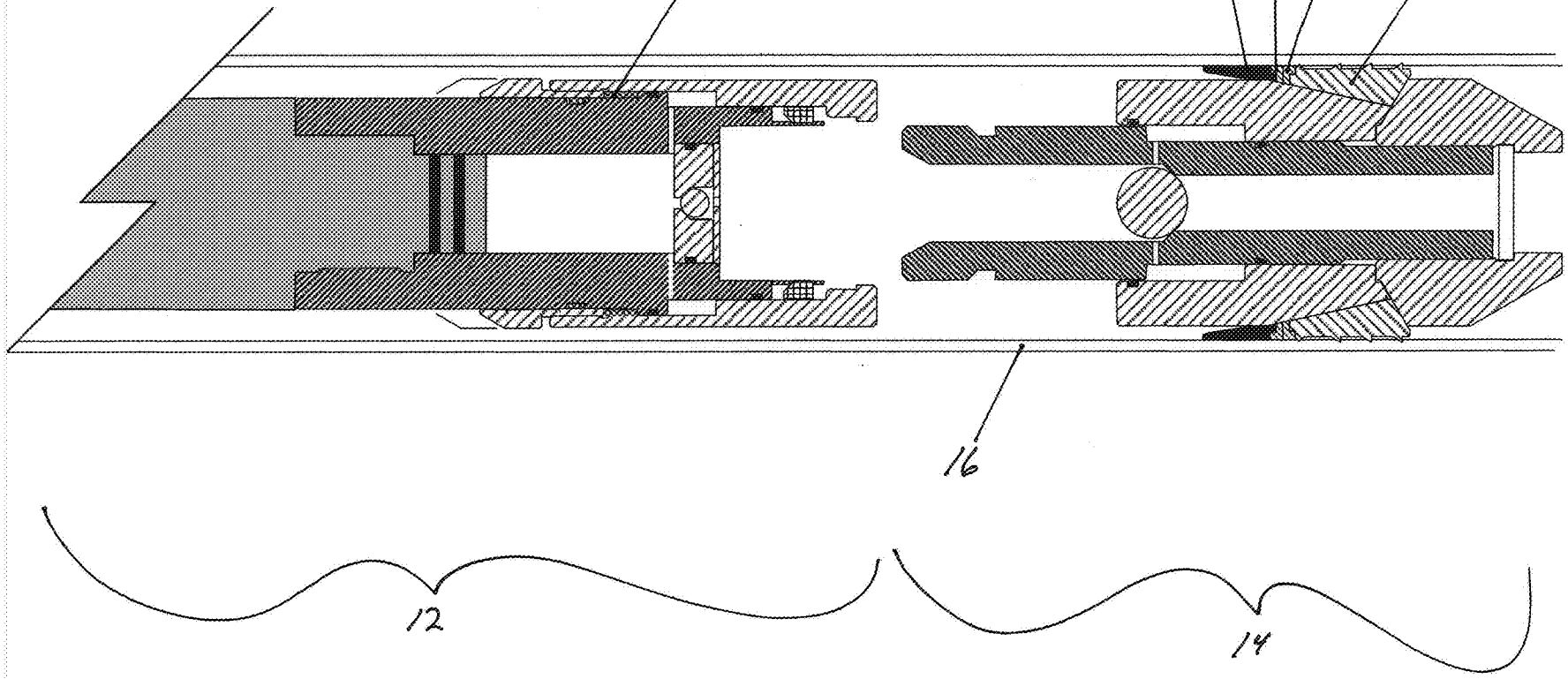
Figure #4 (Power Section Released & Pulling out of Hole)

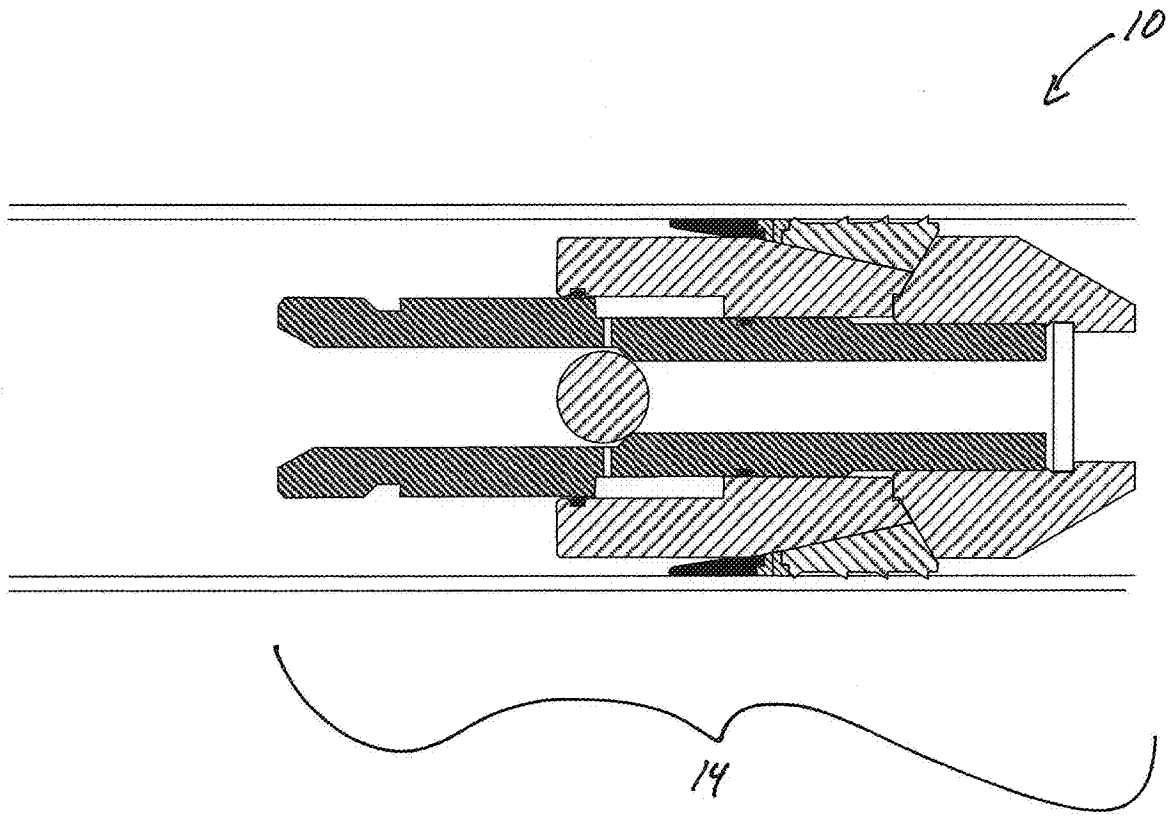
Figure #5 (Plug Set and Ready to Frac)

FRAC PLUG WITH INTEGRAL SETTING TOOL

CROSS-REFERENCE TO RELATED APPLICATIONS

This application claims priority to U.S. Provisional Patent Application No. 62/891,492 filed Aug. 26, 2019, the entire disclosures of which are incorporated herein by reference.

STATEMENT REGARDING FEDERALLY SPONSORED RESEARCH OR DEVELOPMENT

Not applicable.

BACKGROUND OF THE INVENTION

1. Field of the Invention

This invention is in the field of oil and gas communication. More specifically this invention is in the technical field of fracturing a reservoir of a subsurface well.

2. Background of the Invention

In the process of stimulating or fracturing a reservoir of a subsurface formation there is a need to isolate sections of a well as the process of "Plug and Perf" is carried out. This process involves setting a frac plug and then perforating a liner of the well to gain access to the subsurface formation. Once this is done, a fluid is pumped at a high rate and pressure into the formation, "Fracturing" it. This process is then repeated multiple times in the well. To install the frac plug into the well, a setting tool is attached to the frac plug. An electrical current is sent down a wire to the setting tool, which then sets the plug. Currently, the setting tool and the frac plug are two separate components that are required to be assembled at the location of the subsurface well. This results in a long physical assembly that is also less reliable and requires more manpower to produce.

Consequently, there is a need in the art for a combined setting tool and frac plug that does not have to be assembled at the location of a subsurface well. This may result in a shorter physical assembly with increased reliability while managing to decrease the manpower needed to produce the combined tool.

Various devices and methods have been proposed and utilized for isolating sections of a downhole wellbore, including some of the devices and methods in the references appearing on the face of this patent. However, those devices and methods lack all the steps or features of the devices and methods covered by any patent claims below. As will be apparent to a person of ordinary skill in the art, any devices and methods covered by claims of the issued patent solve many of the problems that prior art devices and methods have failed to solve. Also, the devices and methods covered by at least some of the claims of this patent have benefits that could be surprising and unexpected to a person of ordinary skill in the art based on the prior art existing at the time of invention.

SUMMARY

One or more specific embodiments disclosed herein may include a downhole assembly, comprising a plug section comprising: a top sub, a bottom sub, a slip, and an elastomeric element; a power section comprising: a body comprising a power charge and one or more ignitors, a firing head, a shearing pin, and a setting tool piston; a check valve, wherein the check valve is positioned downhole from the power charge and inside the setting tool piston; a mandrel comprising a hydraulic chamber and a ball, wherein the mandrel is positioned inside and adjacent to the setting tool piston and the top sub; and a dog.

One or more specific embodiments disclosed herein may include a method of setting a frac plug in a casing, comprising: positioning a downhole assembly at a specific depth, wherein the downhole assembly comprises: a plug section comprising a top sub, a bottom sub, and a slip; a power section comprising a body, wherein the body comprises a power charge and one or more ignitors, and a shearing pin; a mandrel; and a dog; setting a plug section at the specific depth, wherein the setting step comprises: activating the one or more ignitors, resulting in the power charge being ignited, which results in the production of gas, wherein the gas forces the top sub and the bottom sub towards each other, resulting in the slip contacting the casing, and further wherein the gas forces the shear pin to break, resulting in the dog separating from the mandrel and the plug section separating from the power section; and removing the power section from the casing.

One or more specific embodiments disclosed herein may include a method of setting a frac plug in a casing, comprising: positioning a downhole assembly at a specific depth; setting a plug section at the specific depth, wherein the setting step comprises: activating one or more ignitors, resulting in a power charge being ignited, which results in the production of gas, wherein the gas forces a top sub and a bottom sub towards each other, resulting in a slip contacting the casing, and further wherein the gas forces a shear pin to break, resulting in a dog separating from a mandrel.

BRIEF DESCRIPTION OF THE DRAWINGS

For a detailed description of the preferred embodiments of the invention, reference will now be made to the accompanying drawings in which:

FIG. 1 illustrates an embodiment of a frac plug with integral setting tool in a run-in position;

FIG. 2 illustrates an embodiment of a frac plug with integral setting tool in a plug set position;

FIG. 3 illustrates an embodiment of a power section releasing from a frac plug with integral setting tool;

FIG. 4 illustrates an embodiment of a released power section being pulled out of a well; and FIG. 5 illustrates an embodiment of a set plug.

DETAILED DESCRIPTION

1. Introduction

A detailed description will now be provided. The purpose of this detailed description, which includes the drawings, is to satisfy the statutory requirements of 35 U.S.C. § 112. For example, the detailed description includes a description of the inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details of the systems, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology.

2. Certain Specific Embodiments

Now, certain specific embodiments are described, which are by no means an exclusive description of the inventions. Other specific embodiments, including those referenced in the drawings, are encompassed by this application and any patent that issues therefrom.

One or more specific embodiments disclosed herein may include a downhole assembly, comprising a plug section comprising: a top sub, a bottom sub, a slip, and an elastomeric element; a power section comprising: a body comprising a power charge and one or more ignitors, a firing head, a shearing pin, and a setting tool piston; a check valve, wherein the check valve is positioned downhole from the power charge and inside the setting tool piston; a mandrel comprising a hydraulic chamber and a ball, wherein the mandrel is positioned inside and adjacent to the setting tool piston and the top sub; and a dog.

One or more specific embodiments disclosed herein may include a method of setting a frac plug in a casing, comprising: positioning a downhole assembly at a specific depth, wherein the downhole assembly comprises: a plug section comprising a top sub, a bottom sub, and a slip; a power section comprising a body, wherein the body comprises a power charge and one or more ignitors, and a shearing pin; a mandrel; and a dog; setting a plug section at the specific depth, wherein the setting step comprises: activating the one or more ignitors, resulting in the power charge being ignited, which results in the production of gas, wherein the gas forces the top sub and the bottom sub towards each other, resulting in the slip contacting the casing, and further wherein the gas forces the shear pin to break, resulting in the dog separating from the mandrel and the plug section separating from the power section; and removing the power section from the casing.

One or more specific embodiments disclosed herein may include a method of setting a frac plug in a casing, comprising: positioning a downhole assembly at a specific depth, setting a plug section at the specific depth, wherein the setting step comprises: activating one or more ignitors, resulting in a power charge being ignited, which results in the production of gas, wherein the gas forces a top sub and a bottom sub towards each other, resulting in a slip contacting the casing, and further wherein the gas forces a shear pin to break, resulting in a dog separating from a mandrel.

In any one of the assemblies or methods disclosed herein, wherein the hydraulic chamber may be filled with highly viscous fluid.

In any one of the assemblies or methods disclosed herein, wherein the highly viscous fluid comprises grease.

In any one of the assemblies or methods disclosed herein, wherein the one or more ignitors may comprise black powder.

In any one of the assemblies or methods disclosed herein, wherein the power charge may produce gases.

In any one of the assemblies or methods disclosed herein, wherein the assembly is about 2 feet long.

In any one of the assemblies or methods disclosed herein, wherein the breaking of the shearing the pin occurs at higher pressure than the setting of the plug section.

3. Specific Embodiments in the Figures

The drawings presented herein are for illustrative purposes only and are not intended to limit the scope of the claims. Rather, the drawings are intended to help enable one having ordinary skill in the art to make and use the claimed inventions.

FIG. 1 illustrates a side view of an embodiment of a frac plug with integral setting tool assembly 10 in which assembly 10 is in a run-in-hole (RIH) position. In embodiments, assembly 10 may be disposed inside a casing 16. Further, in embodiments assembly 10 may be attached to a wireline assembly (not illustrated). In embodiments, assembly 10 may comprise a power section 12 and a plug section 14.

Remaining with FIG. 1, in embodiments power section 12 may comprise a setting tool body 18. As shown in FIG. 1, one or more ignitors 20, as well as a firing head 22, may be screwed into the interior of setting tool body 18. Further, in embodiments, setting tool body 18 may also comprise a power charge 24, which may be located in the interior of setting tool body 18 downhole from the one or more ignitors 20. In embodiments, power charge 24 may be installed in a charge area 26. In embodiments, an electrical signal may be sent down a conduit, such as a wireline (not illustrated), to activate the one or more ignitors 20 in the firing head 22 of setting tool body 18. In embodiments, activation of the one or more ignitors 20 may detonate power charge 24. In embodiments, the one or more ignitors 20 may comprise black powder (e.g., gun powder, a mixture of sulfur, charcoal, and saltpeter) that may be ignited from the electrical signal.

Still with FIG. 1, in embodiments, a check valve 28 may be positioned downhole to charge area 26. In embodiments, check valve 28 may comprise a check valve ball 30. Further, in embodiments check valve 28 may be attached to a portion of setting tool body 18, referred to as a lower setting tool body 34, and check valve 28 may further comprise a seal 32 located between check valve 28 and lower setting tool body 34. In embodiments, seal 32 may comprise an elastomeric material.

In embodiments, a shear pin 36 may be attached to the outside of setting tool body 18. Further, in embodiments shear pin 36 may also be attached to a shear ring retainer 38 and a setting tool piston 40. Additionally, in embodiments setting tool body 18 may be in contact with setting tool piston 40, and setting tool body 18 may further comprise a seal 42 located between setting tool body 18 and setting tool piston 40. In embodiments, seal 42 may comprise an elastomeric material.

In embodiments, lower setting tool body 34 and setting tool piston 40 may also be in contact with a dog 44. As seen in FIG. 1, in embodiments in the RIH position, dog 44 may be located in a carved-out portion of a mandrel 46. In embodiments in the RIH position, lower setting tool body 34 and setting tool piston 40 may maintain dog 44 in the carved-out portion of mandrel 46 such that power section 12 and plug section 14 remain connected to each other. Further, in embodiments lower setting tool body 34 may comprise a seal 48, which may be located between lower setting tool body 34 and setting tool piston. In embodiments, seal 48 may comprise an elastomeric seal.

In embodiments, plug section 14 may comprise mandrel 46, a top sub 52, an element 54, an upper slip retaining ring 56, a lower slip retaining ring 58, a slip 60, and a bottom sub 62. In embodiments, mandrel 46 may comprise a hydraulic chamber 50. In embodiments, hydraulic chamber 50 may be filled with a grease or other highly viscous fluid. Further, in embodiments mandrel 46 may comprise a mandrel ball 64. In embodiments, mandrel 46 may be adjacent to top sub 52. Also, in embodiments mandrel 46 may comprise an upper seal 66 and a lower seal 68. In embodiments, upper seal 66 and lower seal 68 may be located between mandrel 46 and top sub 52. In embodiments, upper seal 66 and lower seal 68 may comprise elastomeric materials. Additionally, in embodiments the downhole end of top sub 52 may be tapered so that top sub 52 becomes narrower as it extends downhole.

In operation, assembly 10 may arrive at the location of a subsurface well. In embodiments, assembly 10 may be ready to run into the well after power charge 24 and firing head 22 have been installed. Further, in embodiments, assembly 10 may then be attached to the rest of a bottom hole assembly (BHA).

FIG. 1 illustrates an embodiment of assembly 10 that may be in the RIH position. In this position, in embodiments power charge 24 may be installed into charge area 26, with the one or more ignitors 20 and firing head 22 screwed into setting tool body 18. In embodiments, assembly 10 may then be attached to a wireline assembly (not illustrated) and run into a subsurface wellbore. In embodiments, once the BHA is in position, a signal may be sent down the wireline (not illustrated), activating the one or more ignitors 20. In embodiments, the one or more ignitors 20 may then ignite power charge 24. In embodiments, power charge 24 may produce gasses that increase the pressure in charge area 26.

In embodiments, this pressure in charge area 26 may be transferred through check valve 28, which may increase pressure in hydraulic chamber 50. In embodiments, the pressure may push through a hole 70 in mandrel 46, which may produce a downward (to the right in FIG. 1) force on top sub 52. In embodiments, the only path for the pressure may be through hole 70 given that mandrel ball 64 may be sealing against an angled ledge of mandrel 46. In embodiments, the downward force may push top sub 52 towards bottom sub 62.

FIG. 2 illustrates an embodiment of assembly 10 in a plug set position. In embodiments, as top sub 52 approaches bottom sub 62, element 8, upper slip retainer ring 56, lower slip retaining ring 58, and slip 60 may be pushed up the tapered downhole end of top sub 52 and against casing 16, as illustrated in FIG. 2.

FIG. 3 illustrates an embodiment of assembly 10 with power section 12 being released. In embodiments, the same pressure that is in hydraulic chamber 50 may still be in charge area 26. In embodiments, this pressure may feed through a hole 72 in setting tool body 18, which may apply a force to setting tool piston 40. In embodiments, this force may act against shear pin 36 through shear ring retainer 38. In an alternative embodiment, shear pin 36 may be a shear ring. In embodiments, once a prescribed amount of pressure is applied, shear pin 36 shears, which may allow setting tool piston 40 and shear ring retainer 38 to move downward (to the right in FIG. 3). In embodiments, this downward movement may allow setting tool piston to release dog 44, which may allow dog 44 to disengage from mandrel 46.

FIG. 4 illustrates an embodiment of assembly 10 with power section 12 released from plug section 14. In embodiments, the shearing of shear pin 36 may be set to occur after the hydraulic pressure fully engages element 54, upper slip retaining ring 56, lower slip retaining ring 58, and slip 60 against casing 16.

FIG. 5 illustrates an embodiment of assembly 10 with plug section 14 set.

One advantage of this system is a much shorter physical assembly. Typically, a setting tool is attached to a Wireline Adapter Kit (WLAK), and this WLAK adapts a generic setting tool to an individual manufacturer's frac plug. The last part of the assembly is the actual frac plug. This combined assembly's overall length could range from 4 feet to 8 feet long. In embodiments, the overall length of assembly 10 may be about 2 feet long. The shorter the length, the easier it is to handle at the well location. This shorter length may also provide the operator of the well with the ability to increase other components that are run with assembly 10; most notably are more guns to provide more perforations.

Another advantage is the increased reliability. A typical setting tool and frac plug combination requires the wireline operator to combine the setting tool from one vendor with the WLAK and frac plug from another vendor at the well location for every run. Once this is done the power charge and firing head are connected to the wireline assembly. After every run in the well, the setting tool must be rebuilt, which typically takes about an hour. The process is then repeated before the next plug is run into the well. In the normal process of Plug and Perf'ing a well, this happens anywhere from 4 to 10 times a day. In embodiments of the present invention, these delays may be avoided given that the frac plug with integral setting tool assembly 10 may already be assembled when it arrives at the well location. The only process the wireline field hand may be required to do is to install a power charge, ignitors, and a firing head before attaching the assembly to the rest of the bottom hole assembly (BHA).

Although the present invention and its advantages have been described in detail, it should be understood that various changes, substitutions and alterations may be made herein without departing from the spirit and scope of the invention as defined by the appended claims.

What is claimed is:

1. A downhole assembly, comprising:

a plug section comprising:
- a top sub,
- a bottom sub,
- a slip, and
- an elastomeric element;

a power section comprising:
- a body comprising a power charge and one or more ignitors,
- a firing head,
- a shearing pin, and
- a setting tool piston;

a check valve, wherein the check valve is positioned downhole from the power charge and inside the setting tool piston;

a mandrel comprising a hydraulic chamber and a ball, wherein the mandrel is positioned inside and adjacent to the setting tool piston and the top sub; and a dog.

2. The assembly of claim 1, wherein the hydraulic chamber may be filled with highly viscous fluid.

3. The assembly of claim 2, wherein the highly viscous fluid comprises grease.

4. The assembly of claim 1, wherein the one or more ignitors may comprise black powder.

5. The assembly of claim 1, wherein the power charge produces gases.

6. The assembly of claim 1, wherein the assembly is about 2 feet long.

7. A method of setting a frac plug in a casing, comprising:

positioning a downhole assembly at a specific depth, wherein the downhole assembly comprises:

a plug section comprising a top sub, a bottom sub, and a slip;

a power section comprising a body, wherein the body comprises a power charge and one or more ignitors, and a shearing pin;

a mandrel; and a dog;

setting a plug section at the specific depth, wherein the setting step comprises:

activating the one or more ignitors, resulting in the power charge being ignited, which results in the production of gas, wherein the gas forces the top sub and the bottom sub towards each other, resulting in the slip contacting the casing, and further wherein the gas forces the shear pin to break, resulting in the dog separating from the mandrel and the plug section separating from the power section; and removing the power section from the casing.

8. The method of claim 7, wherein the breaking of the shearing the pin occurs at higher pressure than the setting of the plug section.

9. The method of claim 7, wherein the downhole assembly further comprises a hydraulic chamber.

10. The method of claim 9, wherein the hydraulic chamber is filled with highly viscous fluid.

11. The method of claim 10, wherein the highly viscous fluid comprises grease.

12. The method of claim 7, wherein the one or more ignitors may comprise black powder.

13. The method of claim 7, wherein the downhole assembly is about 2 feet long.

14. A method of setting a frac plug in a casing, comprising:

positioning a downhole assembly at a specific depth, the down hole assembly comprising a plus section and a power section;

setting the plug section at the specific depth, wherein the setting step comprises:

activating one or more ignitors, resulting in a power charge in the power section being ignited, which results in the production of gas, wherein the gas forces a top sub and a bottom sub towards each other, resulting in a slip of the plus section contacting the casing, and further wherein the gas forces a shear pin to break, resulting in a dog separating from a mandrel and the plus section separating from the power section thereby allowing the power section to be withdrawn from the plug section.

15. The method of claim 14, wherein the breaking of the shearing the pin occurs at higher pressure than the setting of the plug section.

16. The method of claim 14, wherein the downhole assembly further comprises a hydraulic chamber.

17. The method of claim 16, wherein the hydraulic chamber is filled with highly viscous fluid.

18. The method of claim 17, wherein the highly viscous fluid comprises grease.

19. The method of claim 14, wherein the one or more ignitors may comprise black powder.

20. The method of claim 14, wherein the downhole assembly is about 2 feet long.

* * * * *